US010170037B2

(12) United States Patent
Choi

(10) Patent No.: US 10,170,037 B2
(45) Date of Patent: Jan. 1, 2019

(54) CONTROLLER, ORGANIC LIGHT-EMITTING DISPLAY PANEL, ORGANIC LIGHT-EMITTING DISPLAY DEVICE, AND METHOD OF DRIVING THE SAME

(71) Applicant: LG Display Co., Ltd., Seoul (KR)

(72) Inventor: SoekMin Choi, Gangwon-do (KR)

(73) Assignee: LG Display Co., Ltd., Seoul (KR)

( * ) Notice: Subject to any disclaimer, the term of this patent is extended or adjusted under 35 U.S.C. 154(b) by 56 days.

(21) Appl. No.: 14/875,859

(22) Filed: Oct. 6, 2015

(65) Prior Publication Data

US 2016/0189628 A1 Jun. 30, 2016

(30) Foreign Application Priority Data

Dec. 30, 2014 (KR) ..... 10-2014-0192892

(51) Int. Cl.
*G09G 3/3233* (2016.01)

(52) U.S. Cl.
CPC ... *G09G 3/3233* (2013.01); *G09G 2300/0842* (2013.01); *G09G 2320/0223* (2013.01); *G09G 2320/0233* (2013.01); *G09G 2320/0295* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 7,474,282 | B2 | 1/2009 | Okamoto | |
| 8,427,405 | B2 * | 4/2013 | Takasugi | G09G 3/3233 345/82 |
| 2003/0201955 | A1 | 10/2003 | Song et al. | |
| 2010/0060147 | A1 * | 3/2010 | Eom | H01L 51/5234 313/504 |
| 2014/0354698 | A1 * | 12/2014 | Lee | G09G 3/3258 345/690 |
| 2015/0348463 | A1 * | 12/2015 | Lee | G09G 3/3233 345/690 |

FOREIGN PATENT DOCUMENTS

| | | | |
|---|---|---|---|
| CN | 1452151 | A | 10/2003 |
| CN | 102214440 | A | 10/2011 |
| CN | 104183208 | A | 12/2014 |

OTHER PUBLICATIONS

The First Office Action dated Nov. 28, 2017 from the State Intellectual Property Office of the People's Republic of China in counterpart Chinese application No. 201510706006.5.

* cited by examiner

*Primary Examiner* — Duane N Taylor, Jr.
(74) *Attorney, Agent, or Firm* — Morgan, Lewis & Bockius LLP

(57) ABSTRACT

A controller, an organic light-emitting display panel, an organic light-emitting display device, and a method of driving the same able to compensate for the dropped driving voltage, thereby preventing image quality from being degraded due to the dropped driving voltage.

8 Claims, 16 Drawing Sheets

$$DATA = DATA(0) + \triangle DATA * Cd$$

$$Vdata = Vdata(0) + \triangle Vdata * Cv$$

CONTROLLER, ORGANIC LIGHT-EMITTING DISPLAY PANEL, ORGANIC LIGHT-EMITTING DISPLAY DEVICE, AND METHOD OF DRIVING THE SAME

CROSS REFERENCE TO RELATED APPLICATION

This application claims priority from and the benefit under 35 U.S.C. § 119(a) of Korean Patent Application Number 10-2014-0192892 filed on Dec. 30, 2014, which is hereby incorporated by reference for all purposes as if fully set forth herein.

BACKGROUND OF THE INVENTION

Field of the Invention

The present invention relates to a controller, an organic light-emitting display panel, an organic light-emitting display device, and a method of driving the same.

Description of Related Art

Organic light-emitting display devices have recently been prominent as next generation display devices. Such organic light-emitting display devices have inherent advantages, such as relatively fast response speeds, high contrast ratios, high light-emitting efficiency, high luminance levels, and wide viewing angles, since organic light-emitting diodes (OLEDs) able to emit light by themselves are used therein.

Each subpixel disposed on an organic light-emitting display panel of such an organic light-emitting display device commonly includes a driving transistor driving an OLED, a switching transistor transferring a data voltage to a gate node of the driving transistor, and a capacitor maintaining a constant voltage during the period of a single frame.

The driving transistor in each subpixel has unique characteristics, such as a threshold voltage and mobility, which may differ according to driving transistors.

Degradations in the performance of the driving transistors may occur along with the lapse of driving time. Differences in degrees of degradation may cause variations in the characteristics of the driving transistors.

Such variations in the characteristics of the driving transistors may cause variations in luminance, leading to non-uniformity in the overall luminance of the organic light-emitting display panel.

Therefore, technologies for compensating for variations in the characteristics of driving transistors have been developed. However, regardless of compensation for variations in the characteristics of the driving transistors, the luminance of each subpixel may be lower than a desired level, leading to poor image quality due to, for example, stains.

BRIEF SUMMARY OF THE INVENTION

Accordingly, the present invention is directed to a controller, an organic light-emitting display panel, an organic light-emitting display device, and a method of driving the same that substantially obviate one or more of the problems due to limitations and disadvantages of the related art.

An object of the present invention is to provide a controller, an organic light-emitting display panel, an organic light-emitting display device, and a method of driving the same that is able to compensate for the dropped driving voltage.

Another object of the present invention is to provide a controller, an organic light-emitting display panel, an organic light-emitting display device, and a method of driving the same that prevents image quality from being degraded due to dropped driving voltage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

The present disclosure newly defines a decrease in luminance due to a voltage drop in a driving voltage and variations in luminance as reasons for degraded image quality, and provides a controller, an organic light-emitting display panel, an organic light-emitting display device, and a method of driving the same able to compensate for the dropped driving voltage, thereby preventing image quality from being degraded due to the dropped driving voltage.

To achieve these and other advantages and in accordance with the purpose of the present invention, as embodied and broadly described, an organic light-emitting display device comprises an organic light-emitting display panel including a matrix of a plurality of subpixels disposed thereon, the plurality of subpixels having data voltages applied from data lines and driving voltages applied from driving voltage lines; a data driver outputting the data voltages to the data lines; and a timing controller controlling the data driver.

In this organic light-emitting display device, among the plurality of subpixels to which the driving voltages are applied from the driving voltage lines, subpixels located more distantly from start points of the driving voltage lines may have a higher data voltage applied thereto.

In another aspect, an organic light-emitting display panel comprises a data line through which data voltages are transferred; a driving voltage line through which driving voltages are transferred; and a plurality of subpixels having the data voltages applied from the data line and the driving voltages applied from the driving voltage line.

In this organic light-emitting display panel, a subpixel among the plurality of subpixels, to which a driving voltage that has dropped by a greater amount is applied from the driving voltage line, may receive a higher data voltage.

In another aspect, a timing controller comprises a first compensation circuit determining a driving voltage drop compensation value for a subpixel to which a driving voltage that has dropped is applied from a driving voltage line; and a data modifying circuit modifying data regarding the subpixel to which the driving voltage that has dropped is applied from the driving voltage line, based on the driving voltage drop compensation value, and outputting the modified data.

In another aspect, a method of driving an organic light-emitting display device is provided. The organic light-emitting display device includes: an organic light-emitting display panel including a matrix of a plurality of subpixels disposed thereon, the plurality of subpixels having data voltages applied from a data line and driving voltages applied from a driving voltage line; a data driver outputting the data voltages to the data lines; and a timing controller controlling the data driver The method driving the organic light-emitting display device includes: modifying data regarding a subpixel to which a driving voltage that has dropped is applied from the driving voltage line; and outputting the modified data.

According to the example embodiments, it is possible to newly define a decrease in luminance due to a voltage drop in a driving voltage and variations in luminance as reasons for degraded image quality, and can provide the controller, the organic light-emitting display panel, the organic light-emitting display device, and the method of driving the same able to compensate for the dropped driving voltage, thereby preventing image quality from being degraded due to the dropped driving voltage.

It is to be understood that both the foregoing general description are exemplary and explanatory and are intended to provide further explanation of the invention as claimed.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
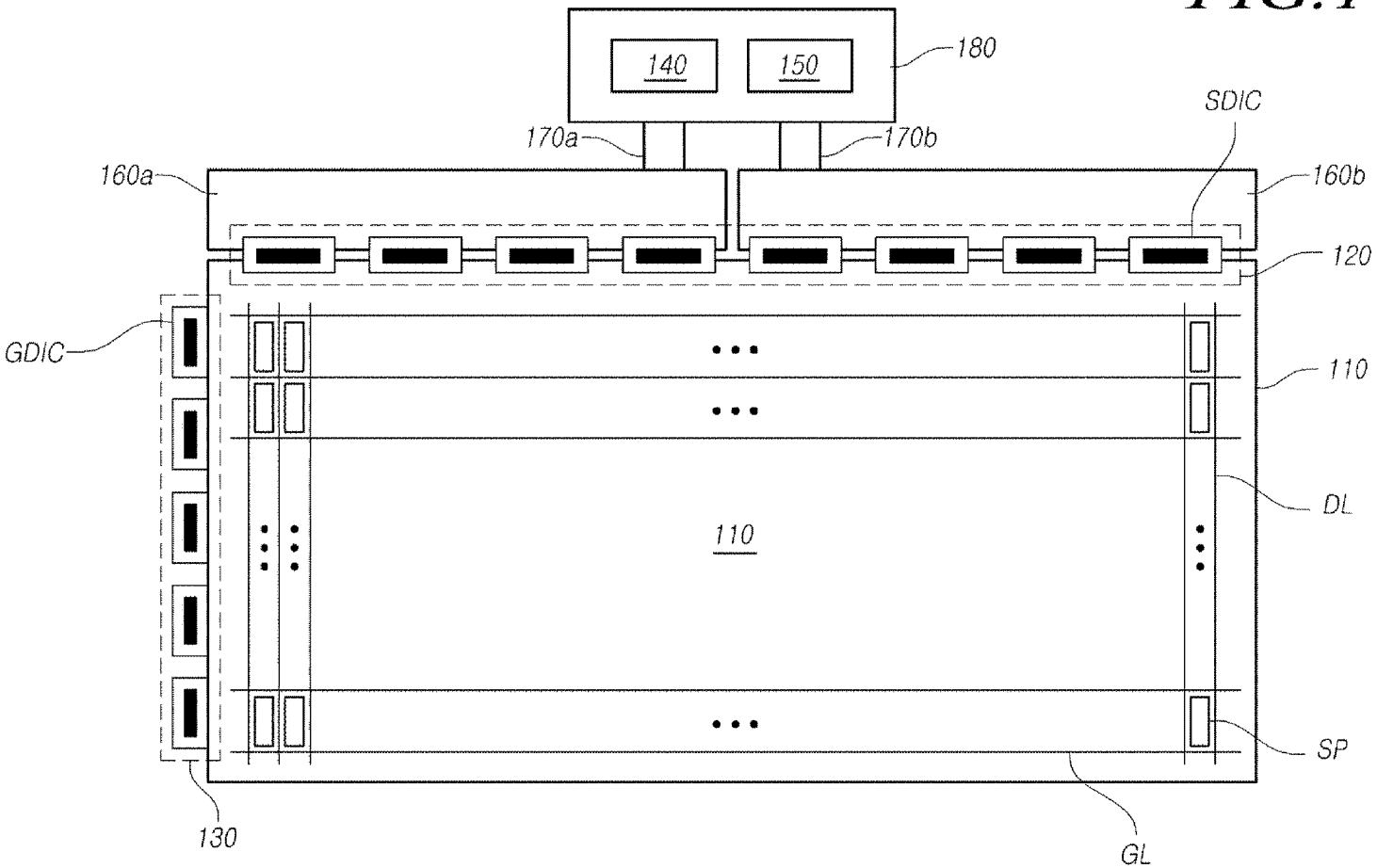
FIG. 1 is a schematic system configuration diagram illustrating an organic light-emitting display device according to example embodiments.

Reference will now be made in detail to embodiments of the present invention, examples of which are illustrated in the accompanying drawings. Throughout this document, reference should be made to the drawings, in which the same reference numerals and signs will be used to designate the same or like components. In the following description of the present invention, detailed descriptions of known functions and components incorporated herein will be omitted in the case that the subject matter of the present invention may be rendered unclear thereby.

It will also be understood that, while terms such as "first," "second," "A," "B," "(a)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic system configuration diagram illustrating an organic light-emitting display device 100 according to example embodiments.

Referring to FIG. 1, the organic light-emitting display device 100 includes an organic light-emitting display panel 110, a data driver 120, a gate driver 130, a timing controller 140, and the like.

On the organic light-emitting display panel 110, a plurality of data lines DL and a plurality of gate lines GL are disposed in intersecting directions.

In addition, a plurality of subpixels SP are arranged on the organic light-emitting display panel 110, forming a matrix.

The data driver 120 drives the plurality of data lines DL by supplying data voltages thereto.

The gate driver 130 sequentially drives the plurality of gate lines GL by sequentially sending a scanning signal thereto.

The timing controller 140 controls the data driver 120 and the gate driver 130 by sending control signals thereto.

The timing controller 140 starts scanning following the timing realized by each frame, outputs converted video data by converting video data input from an external source into a data signal format readable by the data driver 120, and regulates data processing at a suitable point in time in response to the scanning.

The gate driver 130 sequentially drives the plurality of gate lines GL by sequentially sending a scanning signal having an on or off voltage thereto under the control of the timing controller 140.

The gate driver 130 is positioned on one side of the organic light-emitting display panel 110, as illustrated in FIG. 1. Depending on the driving method, the gate driver 130 may be divided into two sections, positioned on both sides of the organic light-emitting display panel 110.

In addition, the gate driver 130 includes one or more gate driver ICs GDIC. Referring to FIG. 1, five gate driver ICs GDIC are illustrated for the sake of explanation.

Each of the gate driver ICs GDIC of the gate driver 130 may be connected to the bonding pads of the organic light-emitting display panel 110 by tape-automated bonding (TAB) or chip-on-glass (COG) bonding, may be implemented as a gate-in-panel (GIP)-type IC directly disposed on the organic light-emitting display panel 110, or in some cases, may be integrated with the organic light-emitting display panel 110, forming a portion of the organic light-emitting display panel 110.

Each of the above-mentioned gate driver ICs GDIC includes a shift resistor, a level shifter, and the like.

When a specific gate line is opened, the data driver 120 drives the plurality of data lines DL by converting video data received from the timing controller 140 into analog data voltages and supplying the analog data voltages to the data lines DL.

The data driver 120 includes one or more source driver ICs (also referred to as data driver ICs) SDIC. Referring to FIG. 1, ten source driver ICs SDIC are illustrated for the sake of explanation.

Each of the source driver ICs SDIC of the data driver 120 may be connected to the bonding pads of the organic light-emitting display panel 110 by tape-automated bonding (TAB) or chip-on-glass (COG) bonding, may be directly disposed on the organic light-emitting display panel 110, or in some cases, may be integrated with the organic light-emitting display panel 110, forming a portion of the organic light-emitting display panel 110.

Each of the source driver ICs SDIC of the data driver 120 includes a shift resistor, a latch, a digital-to-analog converter (DAC), an output buffer, and the like. In some cases, each of the source driver ICs SDIC may include an analog-to-digital converter (ADC) for subpixel compensation. The ADC senses an analog voltage value, converts the sensed analog voltage value into a digital value, and generates and outputs sensing data.

Each of the source driver ICs SDIC of the data driver 120 may be formed using a chip-on-film (COF) method. In each of the source driver ICs SDIC, one end is bonded to a corresponding source printed circuit board (SPCB) of a pair of SPCBs 160*a* and 160*b*, and the other end is bonded to the organic light-emitting display panel 110.

The timing controller 140 receives a variety of timing signals including a vertical synchronization signal Vsync, a horizontal synchronization signal Hsync, an input DE signal, and a clock signal, together with the video data of an input data, from an external source.

In addition to converting the video data input from the external source into a data signal format readable by the data driver 120 and outputting the converted video data, the timing controller 140 generates a variety of control signals by receiving a variety of timing signals including a vertical synchronization signal Vsync, a horizontal synchronization signal Hsync, an input DE signal, and a clock signal, and outputs the variety of control signals to the data driver 120 and the gate driver 130 in order to control the same drivers.

For example, the timing controller 140 outputs a variety of gate control signals (GCSs) including a gate start pulse (GSP), a gate shift clock (GSC) signal, and a gate output enable (GOE) signal in order to control the gate driver 130. The GSP controls the operation start timing of the gate driver ICs GDIC of the gate driver 130. The GSC signal is a clock signal commonly input to the gate driver ICs GDIC to control the shift timing of a scanning signal (gate pulse). The GOE signal designates the timing information of the gate driver ICs GDIC.

The timing controller 140 outputs a variety of data control signals (DCSs) including a source start pulse (SSP), a source sampling clock (SSC) signal, and a source output enable (SOE) signal in order to control the data driver 120. The SSP controls the data sampling start timing of the source driver ICs SDIC of the data driver 120. The SSC signal is a clock signal to control the data sampling timing of each of the source driver ICs SDIC. The SOE signal controls the output timing of the data driver 120.

Referring to FIG. 1, the timing controller 140 is disposed on a control PCB 180. The control PCB 180 is connected to the source PCBs 160*a* and 160*b* via connecting means 170*a* and 170*b*, such as flexible flat cables (FFC) or flexible printed circuits (FPCs).

The control PCB 180 further has a power controller 150 disposed thereon. The power controller 150 supplies a variety of voltages or currents to the organic light-emitting display panel 110, the data driver 120, the gate driver 130, and the like, or controls the variety of voltages or currents to be supplied. The power controller is also referred to as the power management IC (PMIC).

Circuit devices, such as a transistor and a capacitor, are formed on each of the subpixels SP disposed on the organic light-emitting display panel 110 that is schematically illustrated in FIG. 1. For example, a circuit including an organic light-emitting diode (OLED), two or more transistors, and one or more capacitors is formed on each of the subpixels SP on the organic light-emitting display panel 110.

Hereinafter, a description of a subpixel circuit will be given by way of example with reference to FIG. 2 and FIG. 3.

Figure 2:
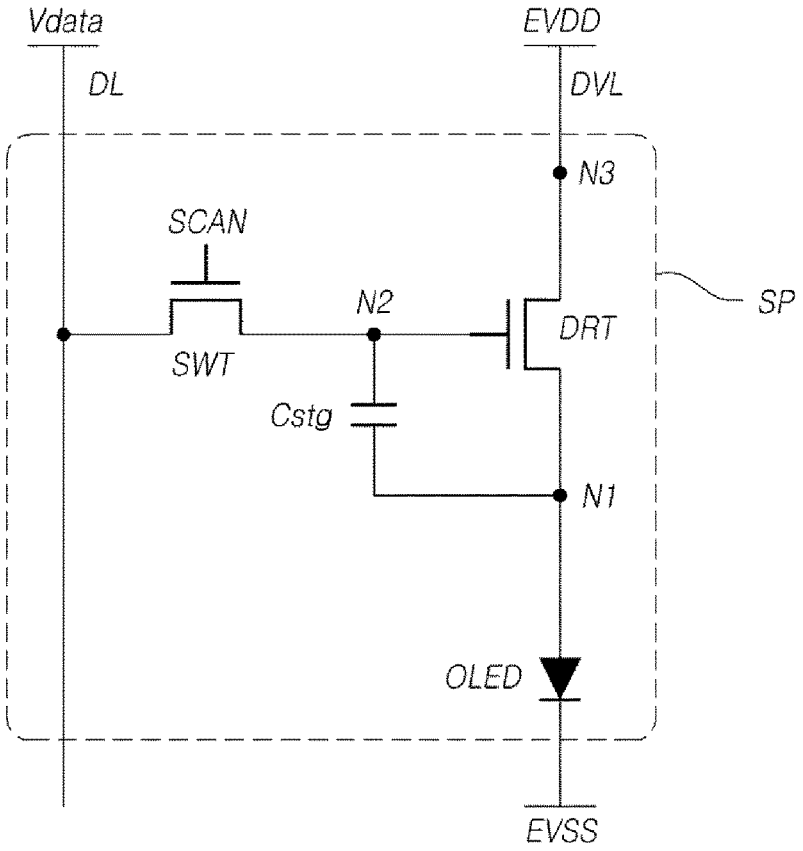
FIG. 2 illustrates an exemplary subpixel circuit of the organic light-emitting display device according to example embodiments.

FIG. 2 illustrates an exemplary subpixel circuit of the organic light-emitting display device 100 according to example embodiments.

Referring to FIG. 2, in the organic light-emitting display device 100, each subpixel may include an OLED and a driving circuit.

Referring to FIG. 2, the driving circuit basically includes two transistors, i.e. a driving transistors DRT and a switching transistor SWT, and a single capacitor, i.e. a storage capacitor Cstg.

Referring to FIG. 2, the OLED includes a first electrode (e.g. an anode or a cathode), an organic layer, and a second electrode (e.g. a cathode or an anode).

For example, a source node or a drain node of the driving transistor DRT may be electrically connected to the first electrode of the OLED, and a base voltage EVSS may be applied to the second electrode of the OLED.

Referring to FIG. 2, the driving transistor DRT is a transistor that drives the OLED by supplying a driving current thereto.

The driving transistor DRT includes a first node N1 corresponding to the source node or the drain node, a second node N2 corresponding to a gate node, and a third node N3 corresponding to the drain node or the source node.

For example, in the driving transistor DRT, the first node N1 may be electrically connected to the first electrode or the second electrode of the OLED, the second node N2 may be electrically connected to a source node or a drain node of the switching transistor SWT, and the third node N3 may be electrically connected to a driving voltage line DVL through which a driving voltage EVDD is supplied.

Referring to FIG. 2, the switching transistor SWT is a transistor that supplies a data voltage Vdata to the second node N2 of the driving transistor DRT, corresponding to the gate node.

The switching transistor SWT is controlled by a scanning signal SCAN applied to the gate node, and is electrically connected between the second node N2 of the driving transistor DRT and a data line DL.

Referring to FIG. 2, the storage capacitor Cstg is electrically connected between the first node N1 and the second node N2 of the driving transistor DRT.

The storage capacitor Cstg serves to maintain a predetermined voltage during the period of a single frame.

The subpixel structure illustrated in FIG. 2 is a most basic 2T1C structure including two transistors DRT and SWT, the single capacitor Cstg, and the single OLED.

The subpixel structure may be variously modified according to various design objectives intended to improve image quality.

For example, each subpixel may have a compensation structure that compensates for the unique characteristics of the driving transistor DRT, such as a threshold voltage Vth and mobility. There are a variety of types of compensation structures, one of which may be decided depending on the type of the driving transistor DRT and the size and resolution of the organic light-emitting display panel 110.

Figure 3:
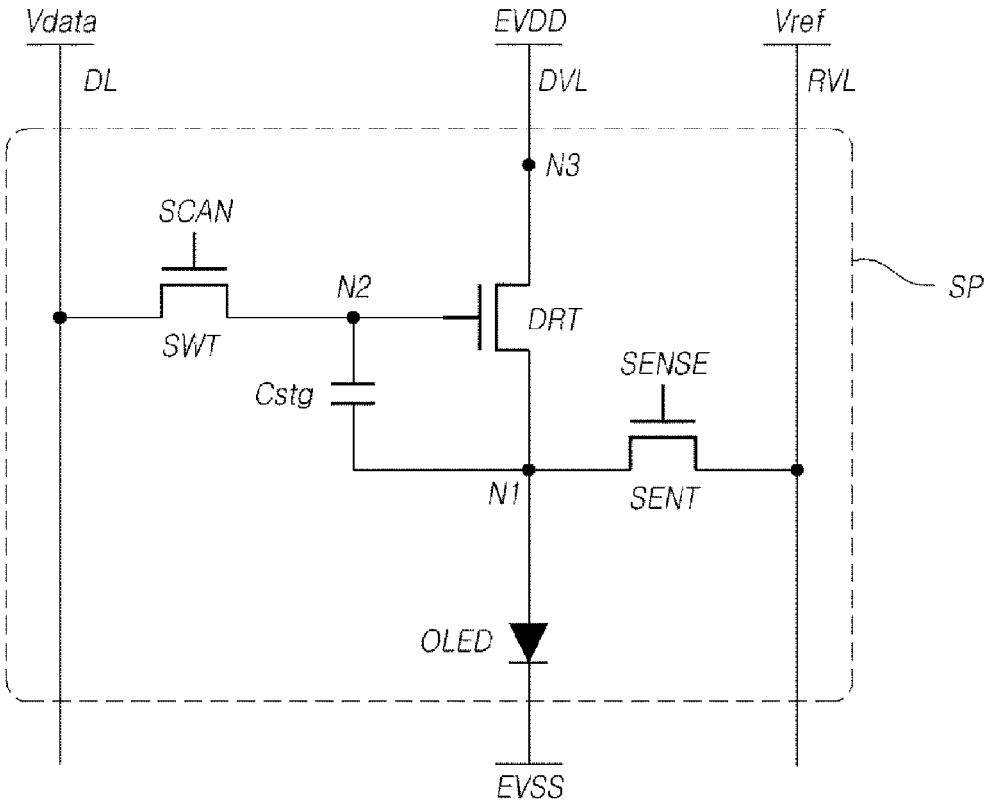
FIG. 3 illustrates another exemplary subpixel circuit of the organic light-emitting display device according to example embodiments.

FIG. 3 illustrates another exemplary subpixel circuit of the organic light-emitting display device 100 according to example embodiments.

Referring to FIG. 3, in the organic light-emitting display device 100, each subpixel may include an OLED and a driving circuit.

Referring to FIG. 3, the driving circuit in the subpixel having a compensation structure includes, by way of example, three transistors, i.e. a driving transistor DRT, a switching transistor SWT, and a sensing transistor SENT, and a single capacitor, i.e. a storage capacitor Cstg.

This type of the subpixel, including the three transistors DRT, SWT, and SENT and the single capacitor Cstg, is referred to as having a "3T1C" structure.

Referring to FIG. 3, the OLED includes a first electrode (e.g. an anode or a cathode), an organic layer and a second electrode (e.g. a cathode or an anode).

For example, a source node or a drain node of the driving transistor DRT is connected to the first electrode of the OLED, and a base voltage EVSS is applied to the second electrode of the OLED.

Referring to FIG. 3, the driving transistor DRT is a transistor that drives the OLED by supplying a driving current thereto.

The driving transistor DRT includes a first node N1 corresponding to the source node or the drain node, a second node N2 corresponding to a gate node, and a third node N3 corresponding to the drain node or the source node. In the following description, for the sake of explanation, the first node N1 may be referred to as the source node, the second node N2 may be referred to as the gate node, and the third node N3 may be referred to as the drain node.

For example, in the driving transistor DRT, the first node N1 is electrically connected to the first electrode or the second electrode of the OLED, the second node N2 is electrically connected to a source node or a drain node of the switching transistor SWT, and the third node N3 is electrically connected to a driving voltage line DVL through which a driving voltage EVDD is supplied.

Referring to FIG. 3, the switching transistor SWT is a transistor that supplies a data voltage Vdata to the second node N2 of the driving transistor DRT, corresponding to the gate node.

The switching transistor SWT is controlled by a scanning signal SCAN applied to the gate node, and is electrically connected between the second node N2 of the driving transistor DRT and a data line DL.

Referring to FIG. 3, the storage capacitor Cstg is electrically connected between the first node N1 and the second node N2 of the driving transistor DRT.

The storage capacitor Cstg serves to maintain a predetermined voltage during the period of a single frame.

Referring to FIG. 3, the sensing transistor SENT, newly added to the basic subpixel structure of FIG. 2, is controlled by a sensing signal SENSE, a type of a scanning signal applied to the gate node, and is electrically connected between a reference voltage line RVL and the first node N1 of the driving transistor DRT.

The sensing transistor SENT is turned on to apply a reference voltage Vref supplied through the reference voltage line RVL to the first node N1 (e.g. the source node or the drain node) of the driving transistor DRT.

In addition, the sensing transistor allows the voltage of the first node N1 of the driving transistor DRT to be sensed by an analog-to-digital converter (ADC) electrically connected to the reference voltage line RVL.

These functions of the sensing transistor SENT relate to the compensation for the unique characteristics of the driving transistor DRT. The unique characteristics of the driving transistor DRT include, for example, a threshold voltage Vth and mobility.

When variations in the unit characteristics (the threshold voltage and mobility) of the driving transistors DRT in the subpixels occur, luminance variations may occur among the subpixels, thereby lowering image quality.

Therefore, it is possible to improve luminance uniformity by compensating for the unique characteristics (the threshold voltage and mobility) of the driving transistors DRT in the subpixels by sensing the unique characteristics (the threshold voltage and mobility) of the driving transistors DRT.

The principle of sensing the threshold voltage of the driving transistor DRT will be briefly described as follows: A source following operation in which a voltage Vs of the source node (the first node N1) of the driving transistor DRT follows a voltage Vg of the gate node (the second node N2) of the driving transistor DRT is enabled. After the voltage of the source node (the first node N1) of the driving transistor DRT is saturated, the voltage of the source node (the first node N1) of the driving transistor DRT is sensed as a sensing voltage. Based on the sensing voltage sensed in this manner, a change in the threshold voltage of the driving transistor DRT can be determined.

Thereafter, the principle of sensing the threshold voltage of the driving transistor DRT will be briefly described. A predetermined voltage is applied to the gate node (the first node N2) of the driving transistor DRT in order to define the current capability characteristics of the driving transistor DRT except for the threshold voltage Vth.

In this manner, the current capability (i.e. mobility) of the driving transistor DRT is relatively determined based on the amount of the voltage charged for the predetermined time, and a correction gain for compensation is accordingly obtained.

The mobility compensation through the mobility sensing as above can be performed for a predetermined time allowed during the operation of a screen. This consequently makes it possible to sense and compensate for the parameters of the driving transistor DRT that change in real time.

The gate node of the switching transistor SWT and the gate node of the sensing transistor SENT are electrically connected to the same gate line.

That is, a gate signal (SCAN, SENSE) is commonly applied to the gate node of the switching transistor SWT and the gate node of the sensing transistor SENT through the same gate line. In this case, the scanning signal SCAN and the sensing signal SENSE are the same gate signal.

Alternatively, the gate node of the switching transistor SWT and the gate node of the sensing transistor SENT may be electrically connected to different gate lines, through which the scanning signal SCAN and the sensing signal SENSE are separately applied thereto.

Figure 4:
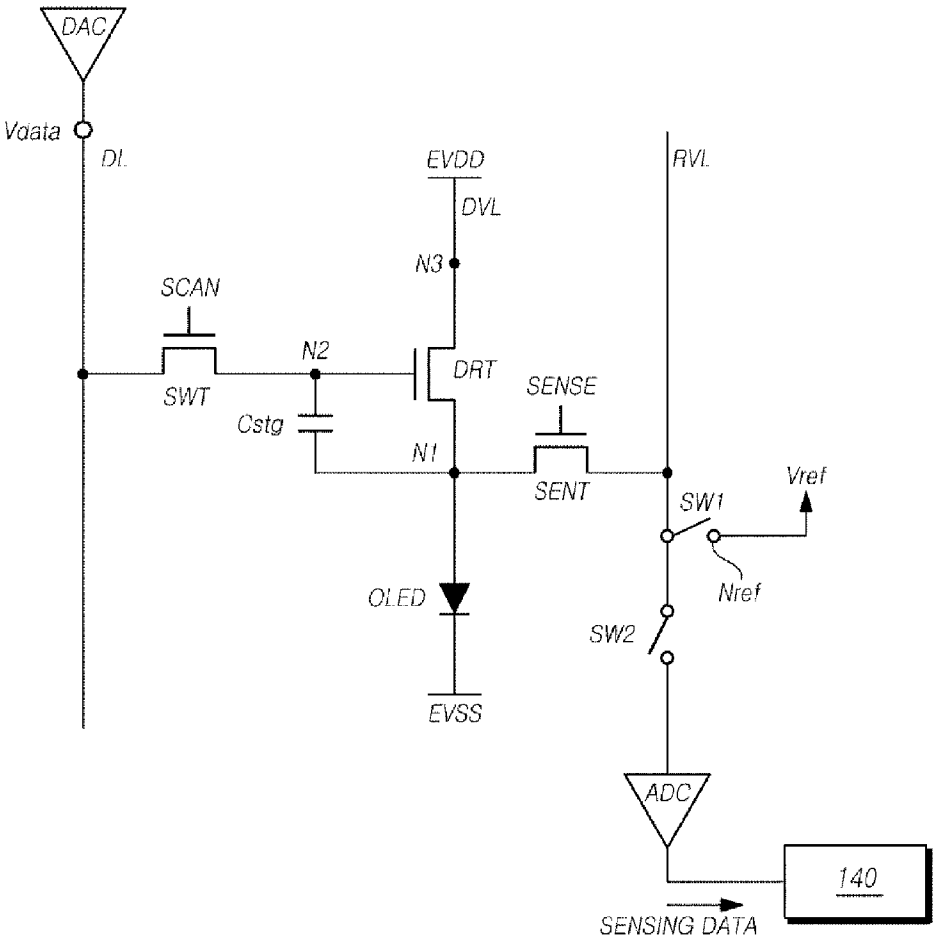
FIG. 4 illustrates an exemplary subpixel circuit and an exemplary compensation structure of the organic light-emitting display device according to example embodiments.

FIG. 4 illustrates an exemplary subpixel circuit and an exemplary compensation structure (a sensing structure for compensating for a threshold voltage and mobility) of the organic light-emitting display device 100 according to the example embodiments.

The subpixel circuit illustrated in FIG. 4 is substantially identical to the subpixel circuit illustrated in FIG. 3.

Referring to FIG. 4, the organic light-emitting display device 100 further includes an analog-to-digital converter (ADC) that senses a voltage of a reference voltage line RVL, generates sensing data by converting the sensed voltage into a digital value, and transmits the sensing data to the timing controller 140.

The use of the ADC enables the timing controller 140 to calculate a compensation value and execute data compensation on a digital basis.

The ADC may be included in each source driver IC SDIC, together with a digital-to-analog converter (DAC) converting video data into a data voltage Vdata.

Referring to FIG. 4, the organic light-emitting display device 100 includes switch components, such as a first switch SW1 and a second switch SW2, in order to provide an effective sensing operation.

In response to a first switching signal, the first switch SW1 connects the reference voltage line RVL and a supply node Nref through which the reference voltage Vref is supplied.

When the first switch SW1 is turned on, the reference voltage Vref is supplied to the reference voltage line RVL. When the first switch SW1 is turned off, the reference voltage Vref is not supplied to the reference voltage line RVL.

The second switch SW2 connects the reference voltage line RVL and the ADC in response to a second switching signal (sampling signal).

When the second switch SW2 is turned on, the reference voltage line RVL is connected to the ADC, which then can sense a voltage of the reference voltage line RVL.

With the above-described switch components SW1 and SW2, the organic light-emitting display device 100 can set a state in which voltages are applied to major nodes, such as the N1 node and the N2 node, to a state required for a driving operation for compensating for the characteristics of a sensing transistor SENT, thereby enabling effective driving, and can sense the unique characteristics of the driving transistor DRT.

The ADC generates the sensing data by converting the sensed voltage into a digital value, and transmits the sensing data to the timing controller 140.

The timing controller 140 receives the sensing data, determines a change in the threshold voltage of the driving transistor DRT in each of the subpixels and variations in the threshold voltage of the driving transistors DRT of the subpixels, and determines and saves data compensation values for each of the subpixels for compensation of such a change and variations.

The timing controller 140 modifies data based on the data compensation value, and transmits the modified data to the source driver IC. Consequently, the source driver IC SDIC converts the modified data to a data voltage using the DAC, and outputs the data voltage to a corresponding data line. In this manner, substantial compensation is performed.

The data modified by the timing controller 140 in order to compensate for variations in the threshold voltage of any subpixel can be expressed using Formula 1 below:

$$\text{Data}=\text{Data}(0)+\Delta\text{Data} \qquad \text{Formula 1}$$

In Formula 1 above, Data(0) indicates data that has not been modified for threshold voltage compensation. ΔData indicates a data compensation value determined for threshold voltage compensation, based on the sensing data. Data indicates data modified for threshold voltage compensation.

The data expressed using Formula 1 is input to the source driver IC SDIC, by which a data voltage expressed using Formula 2 below is applied to the corresponding subpixel.

$$V\text{data}=V\text{data}(0)+\Delta\text{Data} \qquad \text{Formula 2}$$

In Formula 2 above, Vdata(0) indicates a data voltage obtained by modifying the unchanged data Data(0) to an analog voltage value for threshold voltage compensation. ΔVdata is an analog value corresponding to a data compensation value for threshold voltage compensation. Vdata is a data voltage obtained by converting the data modified for threshold voltage compensation into an analog value.

Each of the subpixels on the organic light-emitting display panel 110 may have a data voltage Vdata applied through the data line DL and a driving voltage EVDD applied through the driving voltage line DVL, regardless of whether each of the subpixels is designed as the basic subpixel circuit illustrated in FIG. 2, the subpixel circuit having the compensation structure illustrated in FIG. 3, or any other subpixel circuit.

Thus, the organic light-emitting display panel 110 has a plurality of driving voltage lines DVL disposed thereon, in addition to the plurality of data lines DL and the plurality of gate lines GL illustrated in FIG. 1.

Each of the driving voltage lines DVL may be disposed on a single subpixel column or two or may be disposed on more subpixel columns.

In some cases, each of the driving voltage lines DVL may be disposed on a single subpixel row or may be disposed on two or more subpixel rows.

Hereinafter, for the sake of explanation, the case in which each of the driving voltage lines DVL is disposed on one or more subpixel columns will be used by way of example.

Figure 5:
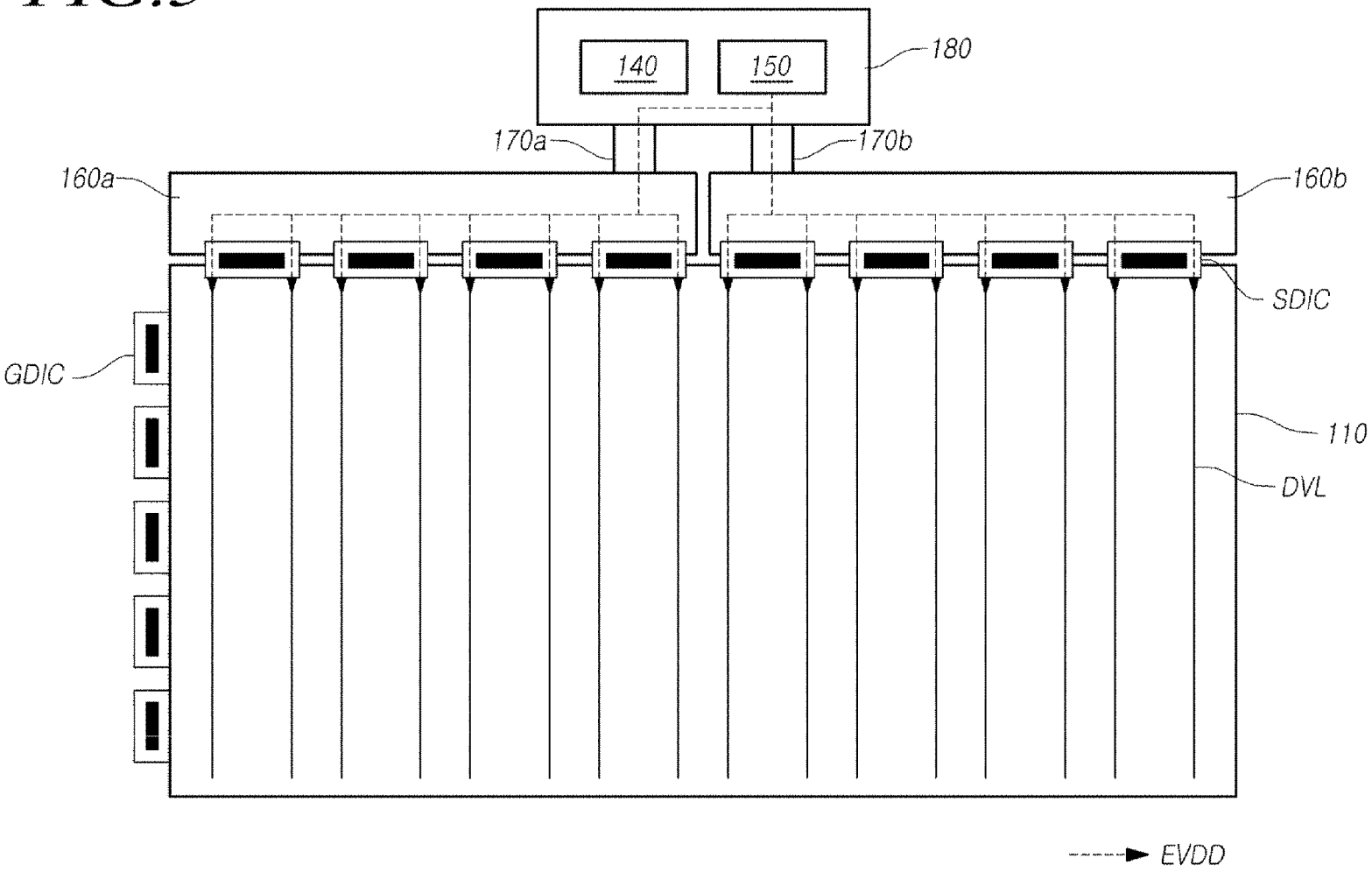
FIG. 5 illustrates a driving voltage supply structure in the organic light-emitting display device according to the example embodiments.
Figure 6:
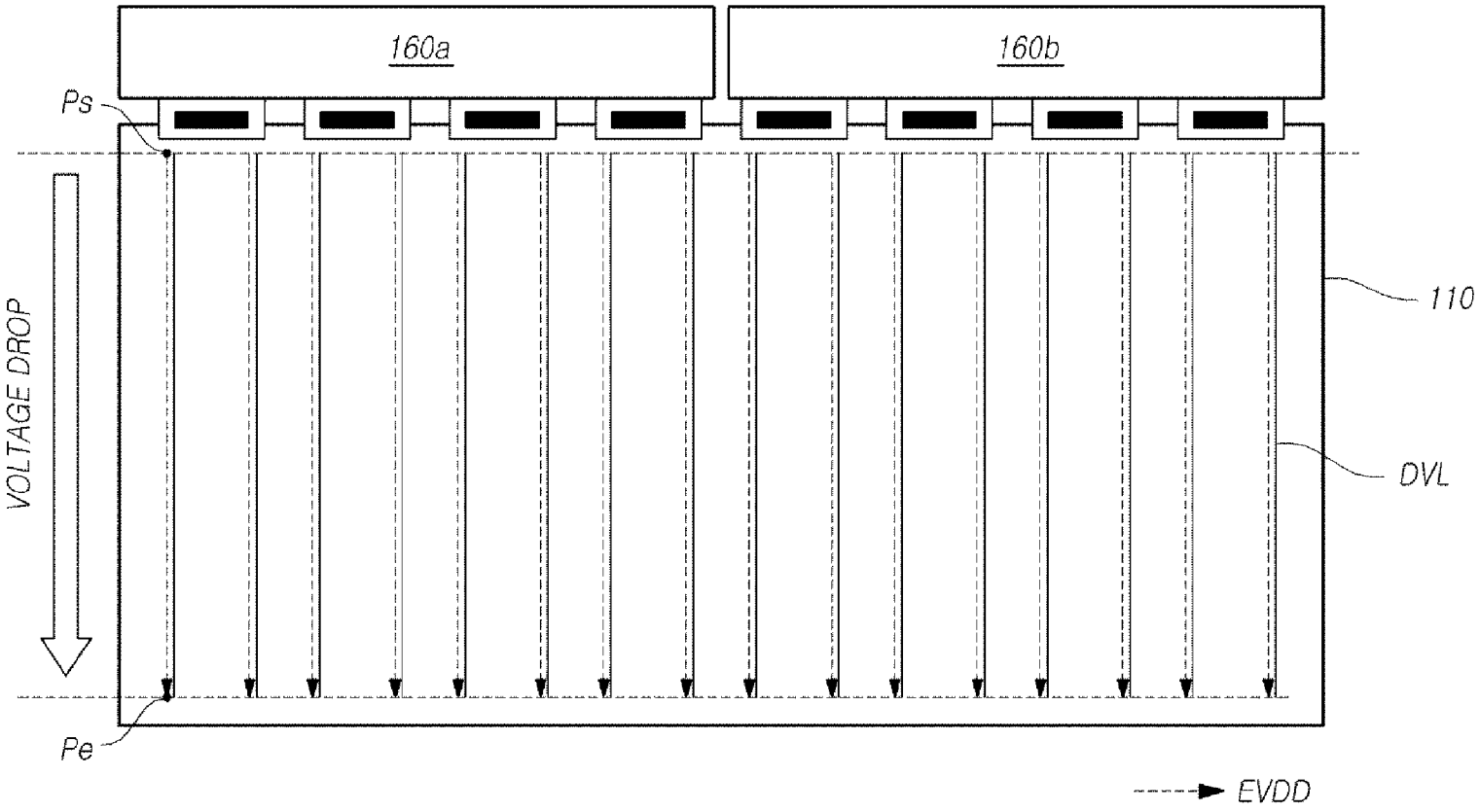
FIG. 6 illustrates a driving voltage drop in the organic light-emitting display device according to the example embodiments.

FIG. 5 illustrates a driving voltage supply structure in the organic light-emitting display device 100 according to the example embodiments, and FIG. 6 illustrates a driving voltage drop in the organic light-emitting display device 100 according to the example embodiments.

Referring to FIG. 5 and FIG. 6, a driving voltage EVDD output by the power controller 150 disposed on the control PCB 180 is supplied to the plurality of driving voltage lines DVL disposed on the organic light-emitting display panel 110 through the connecting means 170*a* and 170*b* and the source driver ICs SDIC disposed on the source PCBs 160*a* and 160*b*.

Referring to FIG. 6, in each of the driving voltage lines DVL, the driving voltage EVDD may drop, for example, due to the length of the corresponding driving voltage line DVL or an internal load of the organic light-emitting display panel 110.

The level of the voltage drop in the driving voltage increases along with the distance from a start point Ps of each driving voltage line DVL. That is, the level of the voltage drop increases as being more adjacent to an end point Pe.

Figure 7:
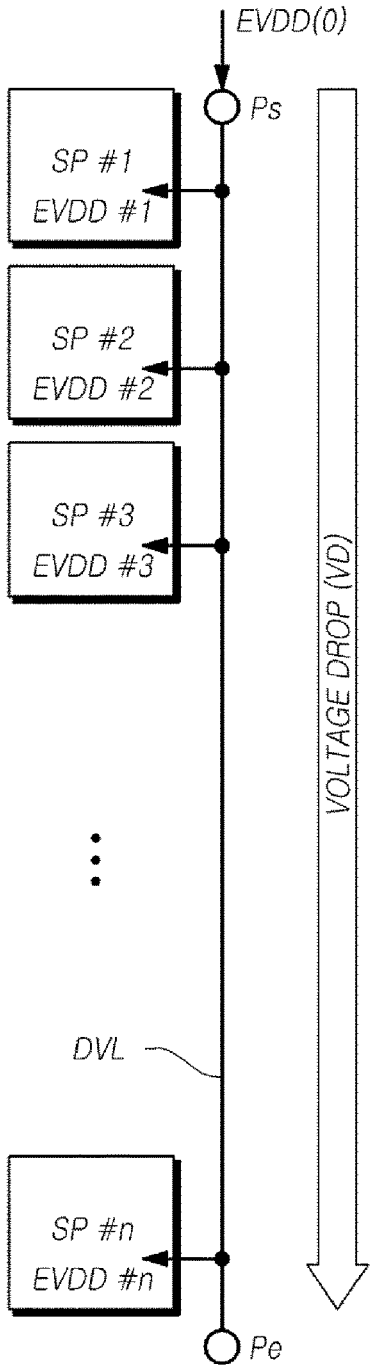
FIG. 7 and FIG. 8 illustrate a driving voltage drop in a single driving voltage line DVL in the organic light-emitting display device according to the example embodiments.
Figure 8:
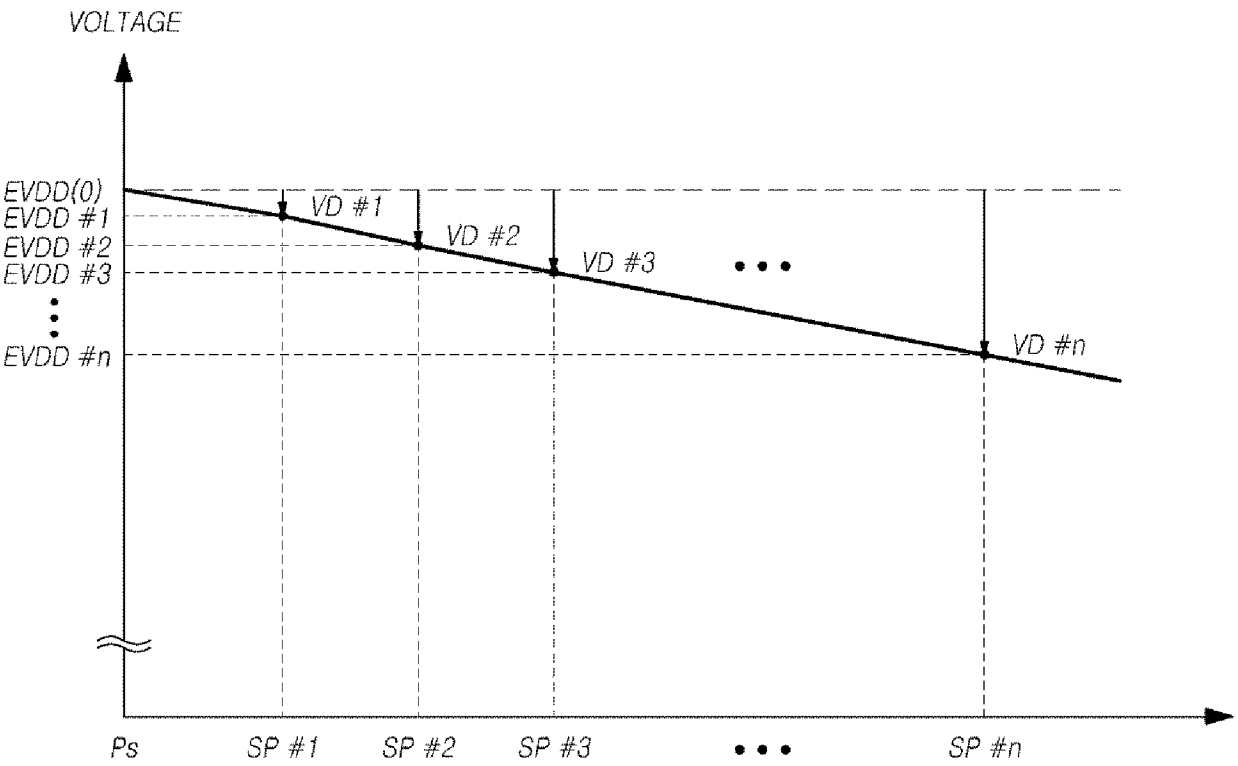

FIG. 7 and FIG. 8 illustrate a driving voltage drop in a single driving voltage line DVL in the organic light-emitting display device 100 according to the example embodiments.

Referring to FIG. 7, a single subpixel column includes n number of subpixels SP #1, SP #2, . . . , and SP #n.

Referring to FIG. 7, the n number of subpixels SP #1 to SP #n may have a driving voltage applied thereto from the single driving voltage line DVL.

Referring to FIG. 7, the n number of subpixels SP #1 to SP #n are arranged in the sequence of SP #1, SP #2, SP #3, . . . , and SP #n from a start point Ps of the driving voltage line DVL. In other words, the subpixel SP #1 is located most adjacently to the start point Ps of the driving voltage line DVL, and the subpixel SP #n is located most distantly from the start point Ps of the driving voltage line DVL.

Referring to FIG. 7 and FIG. 8, the driving voltage EVDD applied to the subpixel SP #1 from the driving voltage line DVL is referred to as EVDD #1, the driving voltage EVDD applied to the subpixel SP #2 from the driving voltage line DVL is referred to as EVDD #2, the driving voltage EVDD applied to the subpixel SP #3 from the driving voltage line DVL is referred to as EVDD #3, and the driving voltage EVDD applied to the subpixel SP #n from the driving voltage line DVL is referred to as EVDD #n.

Referring to FIG. 7 and FIG. 8, the driving voltage applied to each of the subpixels from the driving voltage line DVL is decreased by the voltage drop compared to a driving voltage EVDD(0) supplied to the start point Ps from an external source. Here, the level of the voltage drop increases along with the distance of the subpixel from the start point Ps of the driving voltage line DVL, i.e. in the direction from SP #1 to SP #n.

Specifically, the driving voltage EVDD #1 applied to the subpixel SP #1 from the driving voltage line DVL has the smallest voltage drop VD #1, compared to the driving voltage EVDD(0) supplied to the start point Ps of the driving voltage line DVL. The driving voltage EVDD #n applied to the subpixel SP #n from the driving voltage line DVL has the greatest voltage drop VD #n, compared to the driving voltage EVDD(0) supplied to the start point Ps of the driving voltage line DVL.

The levels of the voltage drops in the driving voltages applied to the subpixels:

$$VD\ \#1 < VD\ \#2 < VD\ \#3 < \ldots < VD\ \#n$$

The levels of the driving voltages applied to the subpixels:

$$EVDD(0) > EVDD\ \#1 > EVDD\ \#2 > EVDD\ \#3 > \ldots > EVDD\ \#n$$

In other words, the more distantly from the start point Ps of the driving voltage line DVL the subpixel is located, the lower the driving voltage applied thereto is.

Referring to FIG. 7 and FIG. 8, the EVDD(0) is not applied to each of the n number of subpixels SP #1 to SP #n that must receive a driving voltage from the driving voltage line DVL. Instead, the driving voltage that has dropped is applied thereto. When the decreased driving voltage is applied, each of the subpixels fails to generate a desired level of luminance, i.e. the level of luminance is lowered by an amount equal to a level by which the driving voltage is dropped.

In addition, the driving voltages applied to each of the n number of subpixels SP #1 to SP #n are lowered by different levels of voltage from EVDD(0). Not only the luminance of each of the n number of subpixels SP #1 to SP #n is decreased, but also variations in the luminance of the n number of subpixels occur.

Such decreases in luminance due to the decreased driving voltages and such variations in luminance due to the different levels of voltage drop may cause degradations in image quality, such as stains formed on the organic light-emitting display panel 110.

For this, the organic light-emitting display device 100 can provide a driving voltage drop compensation function.

Figure 9:
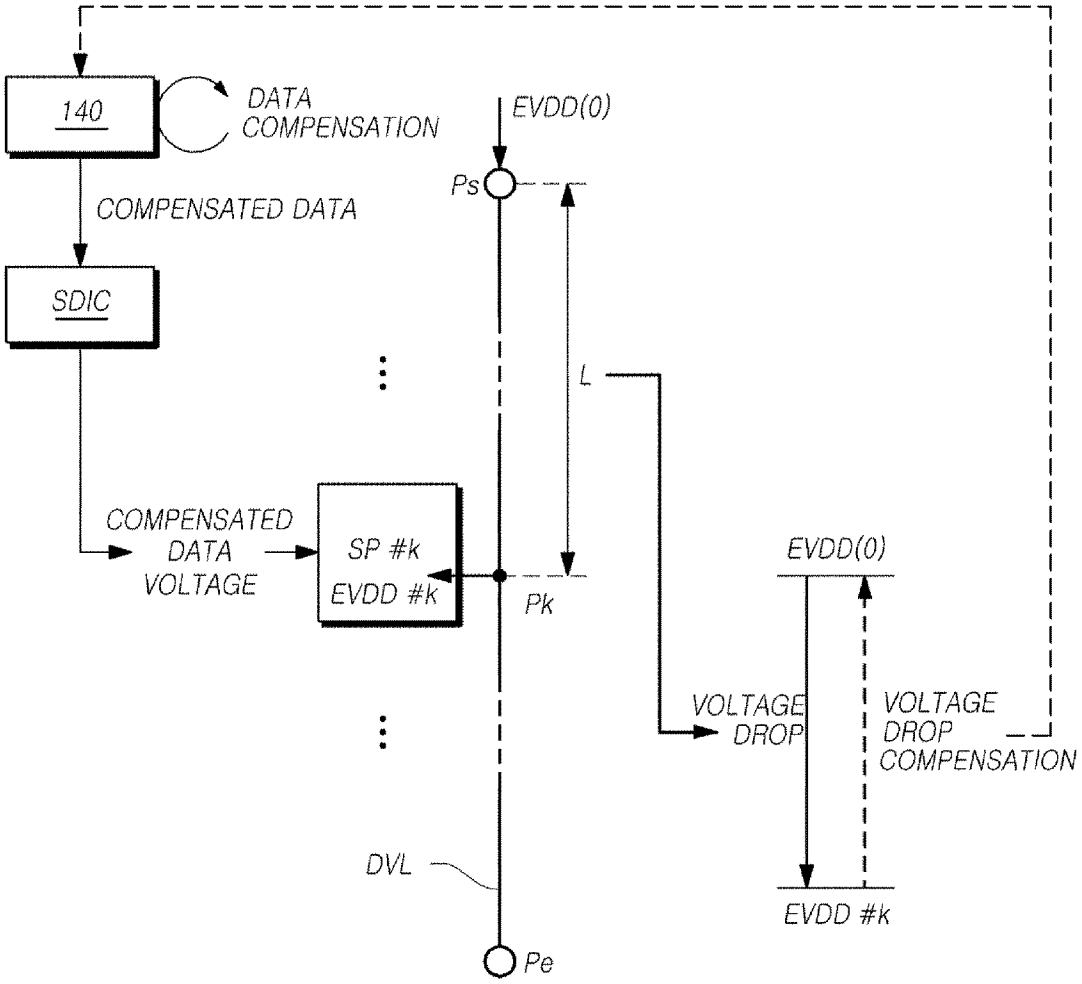
FIG. 9 illustrates a driving voltage drop compensation function of the organic light-emitting display device according to the example embodiments.

FIG. 9 illustrates a driving voltage drop compensation function of the organic light-emitting display device 100 according to the example embodiments. Here, a description will be made, by way of example, to a SP #k (where k=1, 2, . . . , or n) among the n number of subpixels SP #1 to SP #n to which driving voltages from the driving voltage line DVL can be applied.

Referring to FIG. 9, in the organic light-emitting display device 100, the timing controller 140 may output compensated data by compensating data for a voltage drop in a driving voltage EVDD #k applied to the subpixel SP #k. Consequently, the source driver IC SDIC converts the compensated data into an analog data voltage and outputs the analog data voltage.

Referring to FIG. 9, a driving voltage EVDD #k applied to the subpixel SP #k from the driving voltage line DVL is a voltage value decreased by a voltage drop, compared to the driving voltage EVDD(0) that is initially supplied to the start point Ps of the driving voltage line DVL from the external source.

Thus, when the timing controller 140 performs data compensation for the subpixel SP #k, the data compensation is performed based on the level of the voltage drop in the driving voltage EVDD #k applied to the subpixel SP #k.

Referring to FIG. 9, the voltage drop in the driving voltage EVDD #k applied to the subpixel SP #k is proportional to the distance from the start point Ps of the driving voltage line DVL to a point Pk at which the subpixel SP #k receives the driving voltage EVDD #k from the driving voltage line DVL. That is, as the subpixel SP #k is located more distantly from the start point Ps of the driving voltage line DVL, the driving voltage that has dropped by a greater level is applied to the subpixel SP #k.

Since the subpixel SP #k receives the driving voltage dropped by a greater level along with the distance of the subpixel SP #k from the start point Ps of the driving voltage line DVL, the luminance of the subpixel SP #k is decreased by a greater amount.

For this, the timing controller 140 can perform the data compensation on the subpixel SP #k such that a higher data voltage is applied to the subpixel SP #k when the subpixel SP #k is located more distantly from the start point Ps of the driving voltage line DVL, i.e. a driving voltage that has dropped by a greater level is applied to the subpixel SP #k (a lower driving voltage is applied to the subpixel SP #k).

In contrast, data compensation can be performed on the subpixel SP #k such that a lower data voltage is applied to the subpixel SP #k when the subpixel SP #k is located more adjacently to the start point Ps of the driving voltage line DVL, i.e. a driving voltage that has dropped by a smaller level is applied to the subpixel SP #k (a higher driving voltage is applied to the subpixel SP #k).

The driving voltage drop compensation according to the example embodiments as described above can apply a higher data voltage to a subpixel located more distantly from the start point Ps of the driving voltage line DVL among a plurality of subpixels to which the driving voltages are applied from the driving voltage line DVL in order to compensate for the voltage drop, since a lower driving voltage is the subpixel located more distantly from the start point Ps.

That is, the driving voltage drop compensation according to the example embodiments can apply a higher data voltage to a subpixel to which a driving voltage that has dropped by a greater level is applied.

The driving voltage drop compensation according to the example embodiments enables each of the subpixels to receive a data voltage able to compensate for a voltage drop in a driving voltage applied from the driving voltage line DVL. This can consequently prevent the luminance of each of the subpixels from being lowered by the dropped driving voltage and prevent variations in the luminance of the subpixels that would otherwise be caused by the dropped driving voltages.

The voltage drop in the driving voltage and the compensation thereof as described above will be summarized with reference to FIG. 10.

Figure 10:
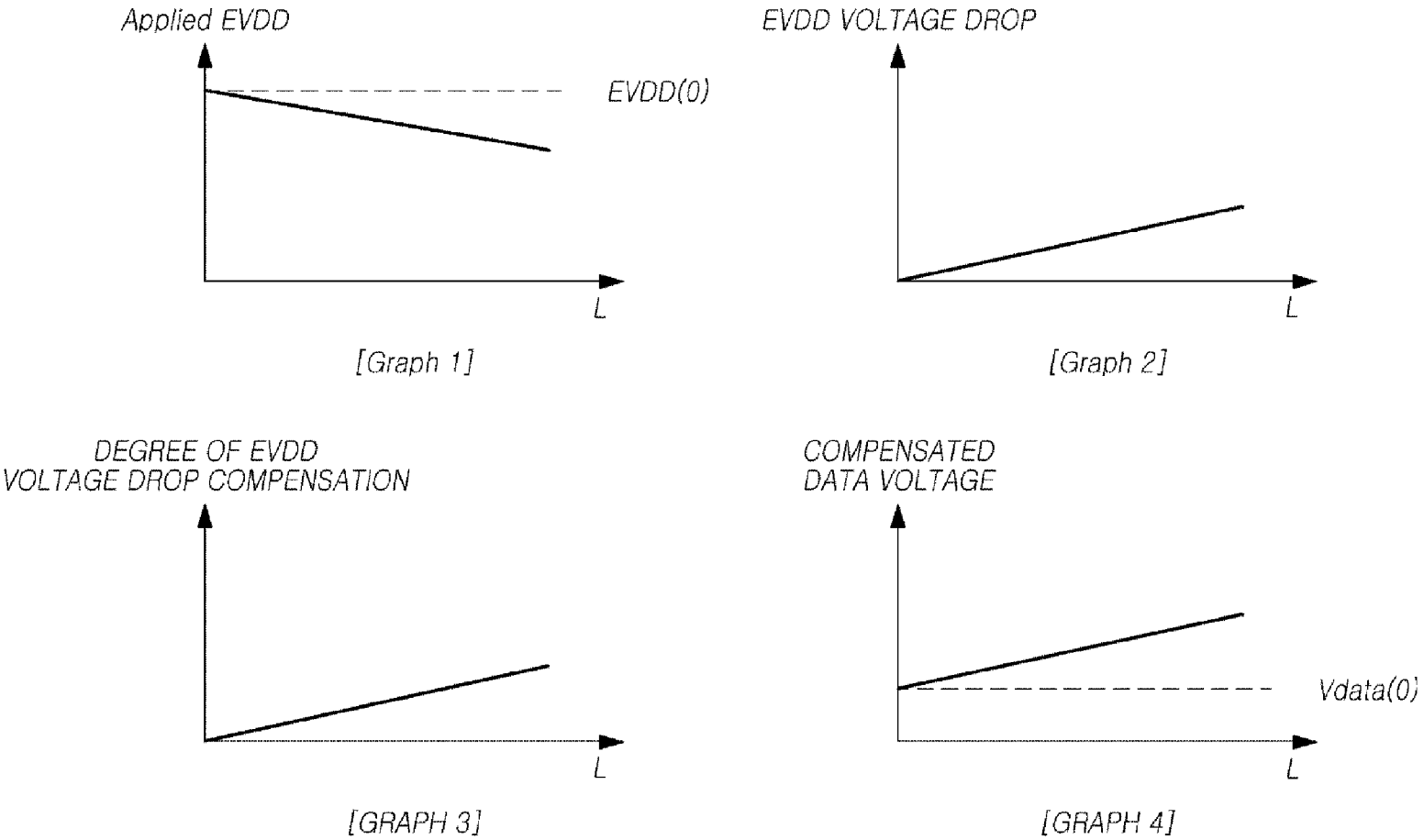
FIG. 10 is a graph representing the relationship between a distance and an applied driving voltage, a graph representing the relationship between the distance and a voltage drop in the driving voltage, a graph representing the relationship between the distance and the degree of driving voltage drop compensation, and a graph representing the relationship between the distance and a data voltage.

FIG. 10 is a graph representing the relationship between a distance L and an applied driving voltage EVDD, a graph representing the relationship between the distance L and a voltage drop in the driving voltage, a graph representing the relationship between the distance L and the degree of driving voltage drop compensation, and a graph representing the relationship between the distance L and a data voltage.

Referring to Graph 1 and Graph 2 in FIG. 10, the voltage drop in the driving voltage EVDD increases along with the distance L from the start point Ps of the driving voltage line DVL, thereby decreasing the driving voltage EVDD.

Consequently, the level of the voltage drop increases along with the distance of the subpixel from the start point Ps of the driving voltage line DVL, whereby a lower driving voltage EVDD is applied to the subpixel.

Referring to Graph 3 in FIG. 10, the degree of the driving voltage drop compensation increases along with the distance L of the subpixel from the start point Ps of the driving voltage line DVL, since the subpixel located more distantly from the start point Ps of the driving voltage line DVL receives the driving voltage that has dropped by a greater level.

Therefore, as represented in Graph 4, the more distantly away from the start point Ps of the driving voltage line DVL the subpixel is located, i.e. the greater the distance L of the subpixel from the start point Ps is, the higher the data voltage is applied to the subpixel.

The organic light-emitting display device 100 according to the example embodiments can further perform threshold voltage compensation in addition to the driving voltage drop compensation.

In this case, the timing controller 140 must perform both data compensation for threshold voltage compensation and data compensation for the driving voltage drop compensation at the same time. Such data compensation will be described with reference to FIG. 11 to FIG. 13.

Figure 11:
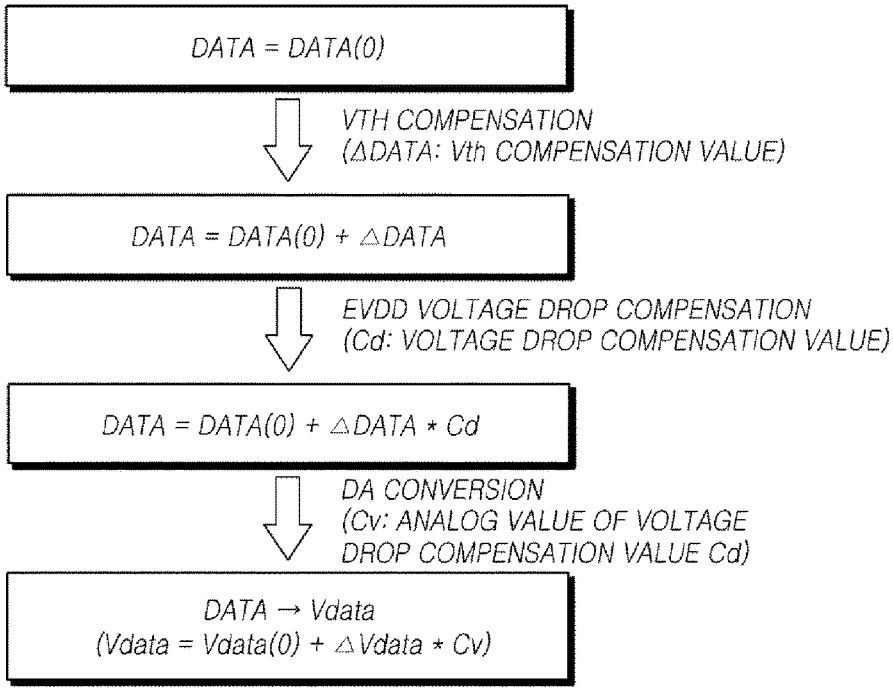
FIG. 11 illustrates data compensation based on threshold voltage compensation and driving voltage compensation in the organic light-emitting display device according to the example embodiments.
Figure 12:
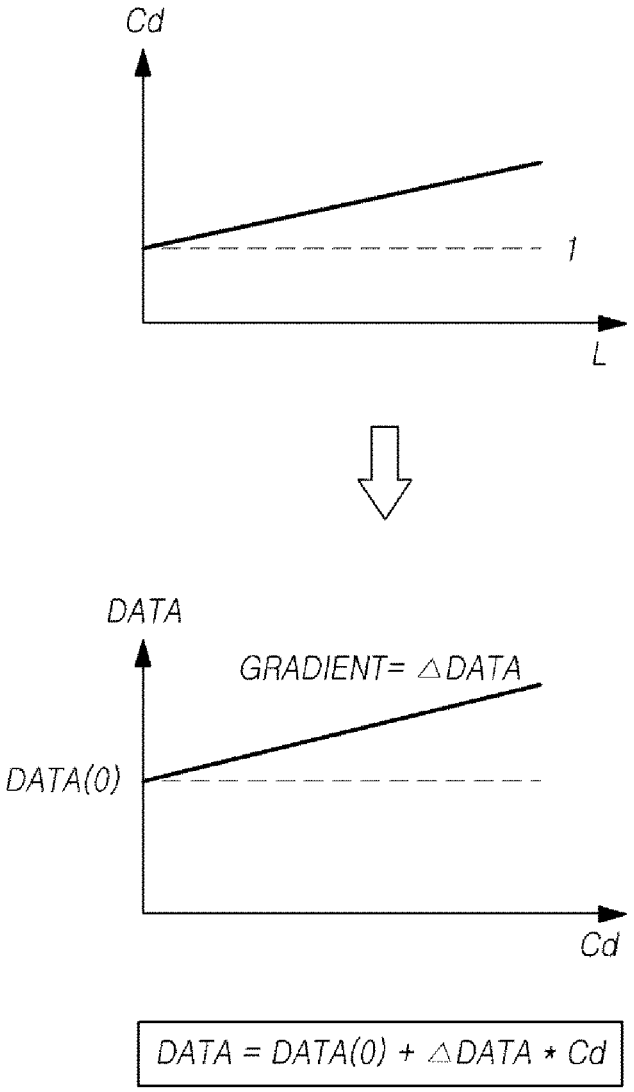
FIG. 12 illustrates compensation data output by the timing controller of the organic light-emitting display device according to the example embodiments.
Figure 13:
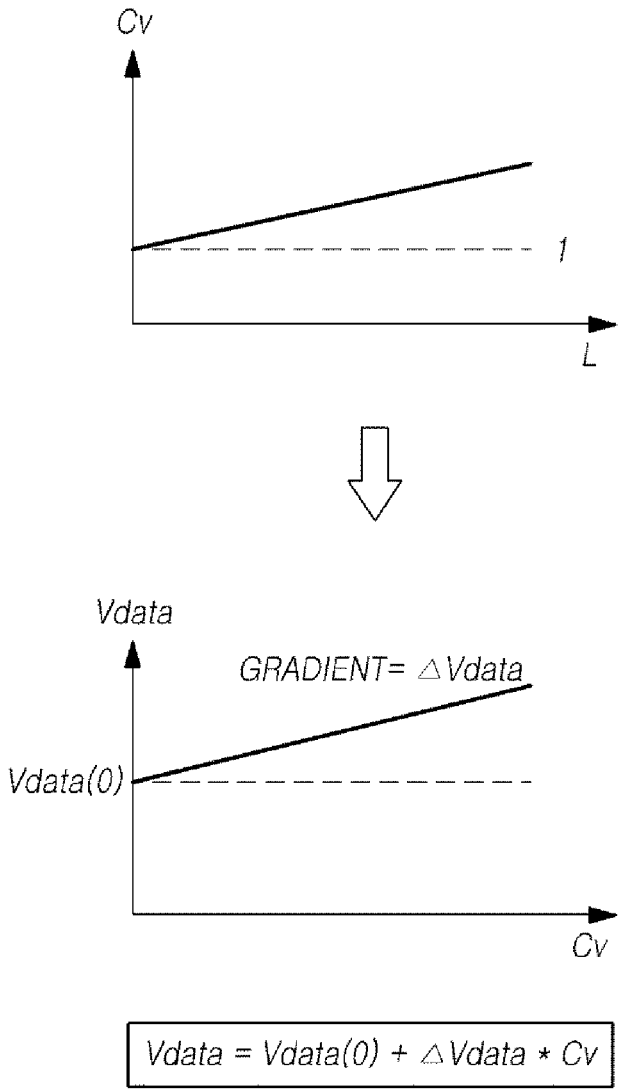
FIG. 13 illustrates compensation data voltages output by a source driver IC of the organic light-emitting display device according to the example embodiments.

FIG. 11 illustrates data compensation based on threshold voltage compensation and driving voltage compensation in the organic light-emitting display device 100 according to the example embodiments, FIG. 12 illustrates compensation data Data output by the timing controller of the organic light-emitting display device 100 according to the example embodiments, and FIG. 13 illustrates compensation data voltages Vdata output by a source driver IC SDIC of the organic light-emitting display device 100 according to the example embodiments.

Referring to FIG. 11, when data that has not been compensated is referred to as Data(0), for the purposes of data compensation for the threshold voltage Vth, the timing controller 140 determines a data compensation value ΔData for the compensation of a threshold voltage Vth from sensing data by calculation.

In this manner, the timing controller 140 can perform the data compensation for the threshold voltage compensation by adding the data compensation value ΔData for the compensation of the threshold voltage Vth to initial data Data(0) that has not been compensated at all.

The compensation data obtained by performing the data compensation for the threshold voltage compensation can be expressed using Formula 3 below:

$$Data=Data(0)+\Delta Data \qquad \text{Formula 3}$$

In Formula 3 above, Data indicates compensation data that is compensated for the threshold voltage compensation, Data(0) indicates initial data that has not been compensated at all, and ΔData indicates a data compensation value (data compensation amount) for the threshold voltage compensation.

Referring to FIG. 11, for the driving voltage drop compensation, the timing controller 140 calculates a driving voltage drop compensation value Cd corresponding to a digital value, depending on the degree of the voltage drop in the driving voltage applied to the corresponding subpixel.

Here, the timing controller 140 determines the degree of the voltage drop in the driving voltage applied to the corresponding subpixel, based on the distance L of the subpixel from the start point Ps of the corresponding driving voltage line DVL.

The distance L of the subpixel from the start point Ps of the driving voltage line DVL may be a value corresponding to the position of the subpixel (a row number and a column number), which is previously decided and is saved in a table.

The timing controller 140 performs the data compensation for the driving voltage drop compensation in order to compensate for a voltage drop in the driving voltage applied to the subpixel. The data compensation includes calculating the driving voltage drop compensation value Cd corresponding to a digital value based on the position information or the like of the subpixel and subsequently adding the initial data Data(0) to a value obtained by multiplying the calculated driving voltage drop compensation value Cd by the data compensation value ΔData regarding the threshold voltage compensation.

Referring to FIG. 11, after the data compensation for the threshold voltage compensation and the driving voltage drop compensation is performed, the compensation data can be expressed using Formula 4 below:

$$Data=Data(0)+\Delta Data*Cd \qquad \text{Formula 4}$$

In Formula 4 above, Data indicates compensation data that has been compensated for the threshold voltage compensation and has been compensated for the driving voltage drop compensation, Data(0) indicates initial data that has not been compensated at all, ΔData is a data compensation value (a data compensation amount) for the threshold voltage compensation, and Cd is a driving voltage drop compensation value for the driving voltage drop compensation.

For example, the driving voltage drop compensation value Cd can be set to a value equal to or greater than 1, as in the graph representing the relationship between L (distance) and Cd. When there is no driving voltage drop (where L=0), the driving voltage drop compensation value Cd is set to 1. When there is a driving voltage drop (where L>0), the driving voltage drop compensation value Cd is set to a value greater than 1. The greater the driving voltage drop is (the greater the distance L is), the greater the driving voltage drop compensation value Cd may be.

In order to represent Formula 4 as a function graph, only the relationship between the driving voltage drop compensation value Cd and the compensation data Data is considered on the assumption that the initial data Data(0) and the data compensation value ΔData for the threshold voltage compensation are constants. As illustrated in FIG. 12, the compensation data may be expressed as a linear function about the driving voltage drop compensation value Cd. In the graph of the linear function, the Y-axis intercept is Data(0), and the gradient is ΔData.

The timing controller 140 outputs the compensation data, which can be expressed using Formula 4, to the corresponding source driver IC SDIC of the data driver 120.

Then, the source driver IC SDIC converts the compensation data Data=Data(0)+ΔData*Cd, received from the timing controller 140, into an analog data voltage Vdata using the DAC disposed therein, and outputs the data voltage Vdata to a corresponding data line.

Here, considering the data compensation (the data compensation for the threshold voltage compensation and the data compensation for the driving voltage drop compensation), the converted data voltage Vdata can be expressed using Formula 5 below:

$$V\text{data}=V\text{data}(0)+\Delta V\text{data}*Cv \qquad \text{Formula 5}$$

In Formula 5 above, Vdata indicates the data voltage obtained by converting the compensation data Data=Data(0)+ΔData*Cd, received from the timing controller 140, into the analog value. Vdata(0) indicates an analog value corresponding to initial data Data(0) that has been subjected to no data compensation. ΔVdata indicates an analog value corresponding to the data compensation value ΔData for the threshold voltage compensation. Cv indicates an analog value corresponding to the driving voltage drop compensation value Cd for the driving voltage drop compensation.

For example, as in the graph of FIG. 13 representing the relationship between L (distance) and Cv, the driving voltage drop compensation value Cv can be set to a value equal to or greater than 1. When there is no driving voltage drop (where L=0), the driving voltage drop compensation value Cd is set to 1. When a driving voltage drop occurs (where L>0), the driving voltage drop compensation value Cd is set to a value greater than 1. The greater the driving voltage drop is (the greater the distance L is), the greater the driving voltage drop compensation value Cd may be.

In order to represent Formula 5 as a function graph, only the relationship between the driving voltage drop compensation value Cv and the compensation data voltage Vdata is considered on the assumption that the data voltage Vdata(0) corresponding to the initial data Data(0) and the analog value ΔVdata corresponding to the data compensation value ΔData for the threshold voltage compensation are constants. As illustrated in FIG. 13, the compensation data voltage Vdata may be expressed as a linear function about the driving voltage drop compensation value Cv. In the graph of the linear function, the Y-axis intercept is Vdata(0), and the gradient is ΔVdata.

Figure 14:
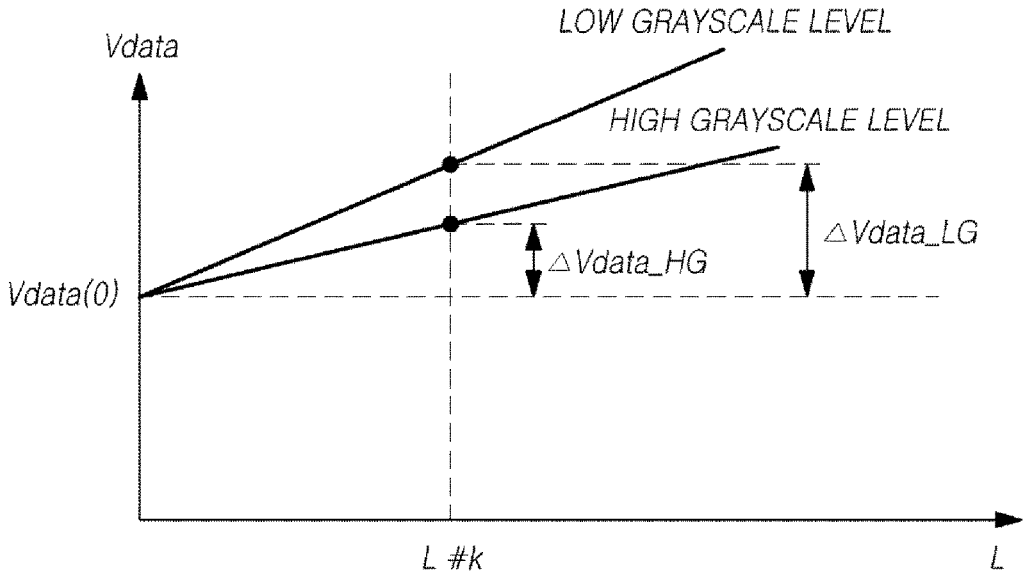
FIG. 14 is a graph representing degrees of data modification depending on grayscale levels when modifying data to compensate for driving voltage drops in the organic light-emitting display device according to the example embodiments.

FIG. 14 is a graph representing degrees of data modification depending on grayscale levels when modifying data to compensate for driving voltage drops in the organic light-emitting display device according to the example embodiments.

As illustrated in FIG. 14, in the case in which the distance of a subpixel SP #k from the start point Ps of the driving voltage line DVL is L #k, when a driving voltage EVDD #k applied from the driving voltage line DVL is a voltage that has dropped from an initial driving voltage EVDD(0), the above-described driving voltage drop compensation function can be applied. Consequently, a driving voltage drop compensation value corresponding to the level of voltage drop, the distance L #k, or the position of the subpixel SP #k can be calculated, and a compensation data voltage Vdata reflecting the calculated driving voltage drop compensation value can be applied to the corresponding subpixel SP #k.

Degradations in image quality depending on the driving voltage drop may differ depending on the grayscale level of data.

Thus, the compensation data voltages to which the driving voltage drop compensation is applied may differ depending on the grayscale levels. That is, the subpixels having driving voltages applied thereto from the driving voltage line DVL may receive different data voltages depending on grayscale levels.

As described above, even in the case in which the same driving voltage drop has occurred, different data voltages can be set depending on the grayscale levels, thereby preventing image quality from being degraded due to the dropped driving voltage.

More specifically, referring to FIG. 14, the image quality degradation, such as stains, caused by the driving voltage drop may become severe in a low grayscale range. Consequently, each of the subpixels to which a driving voltage from the driving voltage line DVL is applied may receive a lower data voltage at a lower grayscale level.

Therefore, as illustrated in FIG. 14, a data voltage change ΔVdata LG corresponding to a level by which the data voltage is changed from the initial data voltage Vdata(0) in a low grayscale range may be greater than a data voltage change ΔVdata HG corresponding to a level by which the data voltage is changed from the initial data voltage Vdata (0) in a high grayscale range.

In other words, the subpixels at the same distance from the start point Ps of the driving voltage line DVL can receive data voltages to which different data voltage changes depending on the grayscale levels are added.

More specifically, among the subpixels at the same distance from the start point Ps of the driving voltage line DVL, a subpixel having a lower grayscale level can receive a higher data voltage to which a greater data voltage change is added.

A reference grayscale level by which the low grayscale range and the high grayscale range are divided may be set to a predetermined grayscale value. For example, the reference grayscale level may be set in the range from 0 to 5 grayscale levels.

As described above, even in the case in which the same driving voltage drop has occurred, i.e. even in the case of subpixels at the same distance from the start point of the driving voltage line, it is possible to apply a higher data voltage to a low grayscale range corresponding to a high-visibility grayscale range by adding a greater data voltage change to the initial data voltage, thereby more efficiently preventing image quality from being degraded due to the dropped driving voltage.

The timing controller 140 can perform the above-described operation of varying the data voltage depending on the grayscale level by adjusting the amount of the driving voltage drop compensation value Cd in Formula 4.

For example, when the grayscale level exceeds the reference grayscale level, the amount of the driving voltage drop compensation value Cd is adjusted because of the driving voltage drop. However, the amount of the driving voltage drop compensation value Cd is not additionally adjusted because of the grayscale level.

When the grayscale level is the reference grayscale level, the amount of the driving voltage drop compensation value Cd is adjusted to a greater value because of the driving voltage drop. Afterwards, the amount of the driving voltage drop compensation value Cd may be further adjusted to a greater value considering the low grayscale range.

Figure 15:
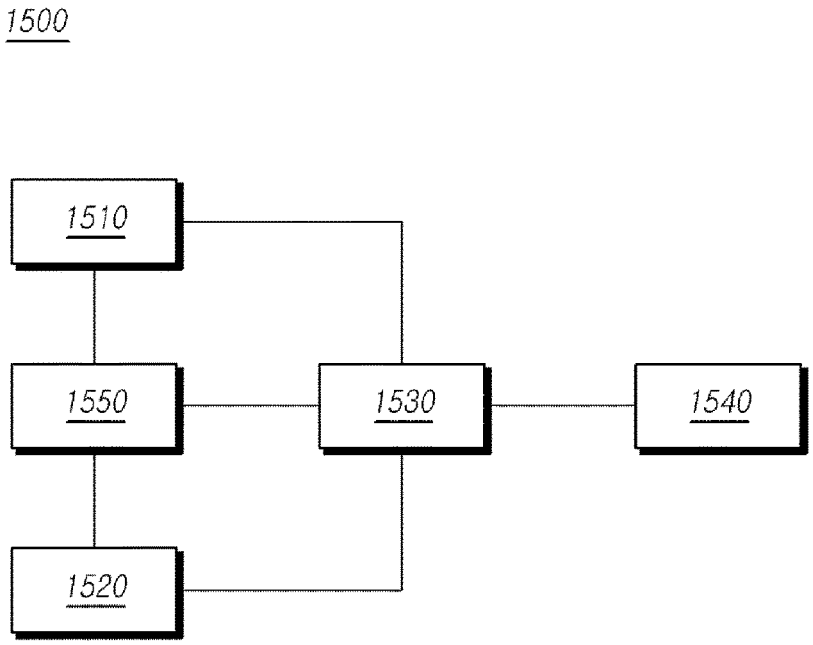
FIG. 15 is a block diagram illustrating a timing controller having a driving voltage drop compensation function in the organic light-emitting display device according to the example embodiments.

FIG. 15 is a block diagram illustrating a controller 1500 having a driving voltage drop compensation function in the organic light-emitting display device 100 according to the example embodiments.

Referring to FIG. 15, in the organic light-emitting display device 100, the controller 1500 having the driving voltage drop compensation function may include a first compensating circuit 1510, a data modifying circuit 1530, and a data output circuit 1540.

The first compensating circuit 1510 determines a driving voltage drop compensation value Cd of a subpixel to which a driving voltage that has dropped is applied from the driving voltage line DVL.

The data modifying circuit 1530 modifies data regarding the subpixel to which the driving voltage that has dropped is applied from the driving voltage line DVL, based on the driving voltage drop compensation value Cd, and outputs the modified data.

Referring to FIG. 15, in the organic light-emitting display device 100, the controller 1500 having the driving voltage drop compensation function may further include a second compensating circuit 1520 that determines a data compensation value (data compensation amount) ΔData for each of the subpixels by referring to sensing data able to be saved in a memory 1550. The data compensation value ΔData is used in compensating for the characteristics (e.g. a threshold voltage and mobility) of the driving transistor DRT.

In this case, the data modifying circuit 1530 modifies data regarding the subpixel to which the driving voltage that has dropped is applied from the driving voltage line DVL, based on the data compensation value ΔData and the driving voltage drop compensation value Cd, and outputs the modified data.

Here, the data may be modified to the compensation data Data=Data(0)+ΔData*Cd as represented in Formula 4 above.

The data, output by the data modifying circuit 1530 through the data modification (data compensation) as above, is output to a corresponding source driver IC by the data output circuit 1540.

The use of the above-described controller 1500 can prevent both lowered luminance and variations in luminance, which would otherwise be caused by the driving voltage drop, thereby preventing image quality from being degraded.

The first compensating circuit 1510 determines the driving voltage drop compensation value Cd of each of the subpixels based on the distance L of each of the subpixels from the start point Ps of the driving voltage line DVL, by referring to the position information of the driving voltage line, the position information of each of the subpixels, and the like that can be saved in the memory 1550.

Since the first compensating circuit 1510 determines the driving voltage drop compensation value Cd of each of the subpixels based on the distance L of each of the subpixels from the start point Ps of the driving voltage line DVL or based on the position of each of the subpixels, it is possible to more adaptively determine the driving voltage drop compensation value Cd depending on the degree of the driving voltage drop. Consequently, it is possible to more efficiently prevent image quality from being degraded due to lowered luminance or variations in luminance.

Degradations in image quality caused by the driving voltage drop may differ depending on the grayscale level of data.

For this, the first compensating circuit 1510 determines the driving voltage drop compensation value Cd by further considering the grayscale level, in addition to the start point of the driving voltage line, the distance of each of the subpixels, and the position of each of the subpixels.

As described above, it is possible to more efficiently prevent image quality from being degraded due to the driving voltage drop by determining the driving voltage drop compensation value Cd by further considering the grayscale level, in addition to the start point of the driving voltage line, the distance of each of the subpixels, and the position of each of the subpixels.

As in Formula 4 above, the data modifying circuit 1530 can perform the data modification (data compensation) by adding a value, obtained by multiplying the data compensation value ΔData for compensating for the characteristics (e.g. a threshold voltage and mobility) of the driving transistor DRT and the driving voltage drop compensation value Cd, to the initial data Vdata(0).

As described above, it is possible to perform both the driving voltage drop compensation for the characteristics of the driving transistor DRT and the data modification for compensating for the driving voltage drop through the single operation of data modification (data compensation).

In addition, the controller 1500 schematically illustrated in FIG. 15 may be the timing controller 140 described in the present disclosure. Alternatively, at least one components of the internal components 1510, 152, 1530, 1540, and 1550 of the controller 1500 may form the timing controller 140 and the other component(s) may form a separate controller device.

Hereinafter, a method of driving the organic light-emitting display device 100 related to the driving voltage drop compensation as described above will be briefly described with reference to FIG. 16.

Figure 16:
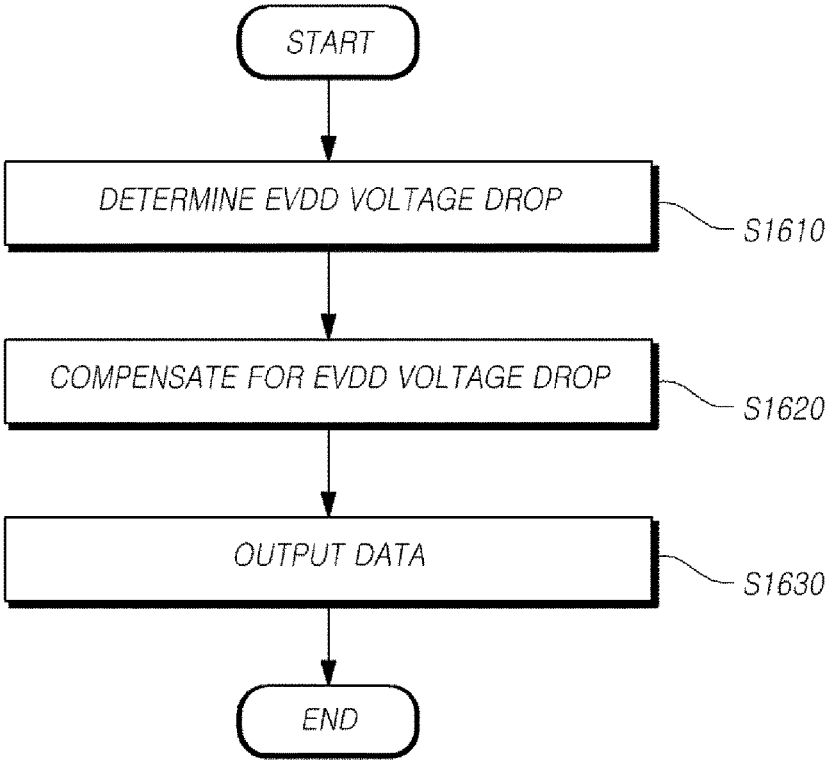
FIG. 16 is a flowchart illustrating a method of driving the organic light-emitting display device according to the example embodiments.

FIG. 16 is a flowchart illustrating the method of driving the organic light-emitting display device 100 according to the example embodiments.

Referring to FIG. 16, the method of driving the organic light-emitting display device 100 may include: operation S1610 of determining whether or not a driving voltage EVDD applied to a subpixel from a driving voltage line DVL has dropped; operation S1620 of modifying data regarding the subpixel to which the driving voltage EVDD that has dropped is applied from the driving voltage line DVL; and operation S1630 of outputting the modified data.

In addition to these operations S1610, S1620, and S1630, other operations for providing the method of driving the organic light-emitting display device 100 related to the driving voltage drop compensation can be further included.

The method of driving the organic light-emitting display device 100 according to the example embodiments as above can compensate for the dropped driving voltage, thereby preventing image quality from being degraded due to the dropped driving voltage.

The example embodiments as set forth above can newly define a decrease in luminance due to a voltage drop in a driving voltage and variations in luminance as reasons for degraded image quality, and can provide the controller 1500, the organic light-emitting display panel 110, the organic light-emitting display device 100, and the method of driving the same able to compensate for the dropped driving voltage, thereby preventing image quality from being degraded due to the dropped driving voltage.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light-emitting display device comprising:

an organic light-emitting display panel comprising a matrix of a plurality of subpixels disposed thereon, the plurality of subpixels having data voltages applied from data lines and driving voltages applied from driving voltage lines;

a data driver outputting the data voltages corresponding to image data to the data lines; and a timing controller receiving input video data and controlling the data driver, wherein the timing controller converts the input video data to the image data, wherein among the plurality of subpixels to which the driving voltages are applied from the driving voltage lines, subpixels located more distantly from start points of the driving voltage lines have a higher data voltage applied thereto via the data lines, wherein the higher data voltage applied to the subpixels located more distantly from the start points is based on a predetermined distance between the subpixels and the start points, wherein, among the plurality of subpixels to which the driving voltages are applied from the driving voltage lines, subpixels located at an equal distance from the start points of the driving voltage lines receive the data voltages to which different data voltage changes depending on grayscale levels are added to the voltage level corresponding to the image data if the grayscale levels of the image data for the respective subpixels are a predetermined low grayscale range, and wherein the different data voltage changes correspond to differences in grayscale levels of the image data of the respective subpixels.

2. The organic light-emitting display device according to claim 1, wherein the subpixels located more distantly from the start points of the driving voltage line have a lower driving voltage.

3. The organic light-emitting display device according to claim 1, wherein, among the subpixels located at the equal distance from the start points of the driving voltage lines, a subpixel with image data having a lower grayscale level receives a data voltage with a greater voltage change added than a subpixel with image data having a higher grayscale level.

4. An organic light-emitting display panel comprising:

a data line through which data voltages corresponding to image data are transferred;

a driving voltage line through which driving voltages are transferred; and a plurality of subpixels having the data voltages applied from the data line and the driving voltages applied from the driving voltage line, wherein a subpixel among the plurality of subpixels, to which a driving voltage that has dropped by a greater amount is applied from the driving voltage line, receives a higher data voltage via the data line, wherein the higher data voltage applied to the subpixel to which the driving voltage has dropped by the greater amount is based on a predetermined distance between the subpixel and a start point of the driving voltage line, wherein, among the plurality of subpixels to which the driving voltages are applied from the driving voltage line, subpixels located at an equal distance from the start points of the driving voltage line receive the data voltages to which different data voltage changes depending on grayscale levels are added to the voltage level corresponding to the image data if the grayscale levels of the image data for the respective subpixels are a predetermined low grayscale range, and wherein the different data voltage changes correspond to differences in grayscale levels of the image data of the respective subpixels.

5. A method of driving an organic light-emitting display device, wherein the organic light-emitting display device comprises: an organic light-emitting display panel comprising a matrix of a plurality of subpixels disposed thereon, the plurality of subpixels having data voltages corresponding to image data applied from a data line and driving voltages applied from a driving voltage line; a data driver outputting the data voltages to the data lines; and a timing controller controlling the data driver, the method comprising:

modifying data regarding a subpixel to which a driving voltage that has dropped is applied from the driving voltage line; and outputting the modified data via the data line, wherein a higher data voltage is applied to subpixels located more distantly from start points of the driving voltage line, the higher data voltage being based on a predetermined distance between the subpixels and the start points, wherein, among the plurality of subpixels to which the driving voltages are applied from the driving voltage line, subpixels located at an equal distance from the start points of the driving voltage line receive the data voltages to which different data voltage changes depending on grayscale levels are added to the voltage level corresponding to the image data if the grayscale levels of the image data for the respective subpixels are a predetermined low grayscale range, and wherein the different data voltage changes correspond to differences in grayscale levels of the image data of the respective subpixels.

6. The organic light-emitting display device according to claim 1, wherein the predetermined distance between the subpixels and the start points is saved in a table stored on the organic light-emitting display device, the table including a row number and a column number of each subpixel.

7. The organic light-emitting display panel according to claim 4, wherein the predetermined distance between the subpixel and the start point is saved in a table stored on the organic light-emitting display device, the table including a row number and a column number of the subpixel.

8. The method according to claim 5, wherein the predetermined distance between the subpixels and the start points is saved in a table stored on the organic light-emitting display device, the table including a row number and a column number of each subpixel.

* * * * *